US007416336B2

(12) United States Patent
Linton et al.

(10) Patent No.: US 7,416,336 B2
(45) Date of Patent: Aug. 26, 2008

(54) TAMPER-EVIDENT SLIDER-ACTUATED STRING-ZIPPERED BAG AND RELATED METHOD OF MANUFACTURE

(75) Inventors: Basil C. Linton, Loganville, GA (US); Gregory H. Crunkleton, Nicolson, GA (US); Jeffrey Griffin, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 537 days.

(21) Appl. No.: 10/903,148

(22) Filed: Jul. 30, 2004

(65) Prior Publication Data

US 2005/0008267 A1 Jan. 13, 2005

Related U.S. Application Data

(63) Continuation-in-part of application No. 10/617,234, filed on Jul. 10, 2003, now Pat. No. 7,107,738.

(51) Int. Cl.
*B65D 33/34* (2006.01)

(52) U.S. Cl. ..... 383/5; 383/61.2; 383/64; 383/204; 383/205

(58) Field of Classification Search ..... 383/5, 383/61.2, 64, 204, 205
See application file for complete search history.

(56) References Cited

U.S. PATENT DOCUMENTS 4,191,230 A 3/1980 Ausnit
4,927,271 A * 5/1990 Branson ..... 383/5
5,023,122 A 6/1991 Boeckmann et al.
5,276,950 A * 1/1994 Johnson ..... 24/585.12
6,065,872 A * 5/2000 Johnson ..... 383/63
6,220,754 B1 4/2001 Stiglic et al.
6,257,763 B1 * 7/2001 Stolmeier et al. ..... 383/5
6,347,885 B1 2/2002 Buchman
6,354,738 B1 3/2002 Buckman et al.
6,360,513 B1 * 3/2002 Strand et al. ..... 53/412
6,409,384 B1 6/2002 Provan et al.
6,477,821 B1 11/2002 Bois (Continued)

FOREIGN PATENT DOCUMENTS

EP 1223111 A2 7/2002

(Continued)

*Primary Examiner*—Nathan J Newhouse
*Assistant Examiner*—Jack H Morgan, Jr.
(74) *Attorney, Agent, or Firm*—Ostrager Chong Flaherty & Broitman P.C.

(57) ABSTRACT

Reclosable bags having a slider-actuated string zipper and tamper-evident features. In one aspect, the bag comprises: a receptacle having a mouth and an interior volume; a string zipper installed in the mouth; a slider mounted to the string zipper; a membrane depending within the interior volume to block access to a portion of the interior volume when the string zipper is open; and a hood joined to the receptacle and shrouding the mouth. The membrane is made by forming a gusset. Then a string zipper is installed inside of the gusset and heat sealed in place. Later a hood or shroud is attached to the bag walls at an elevation traversed by the gusset panels. A layer of non-sealable material is applied on a surface of a gusset panel to prevent the gusset panels from being sealed together when the hood is heat sealed to the bag walls.

8 Claims, 6 Drawing Sheets

U.S. PATENT DOCUMENTS

| | | | | |
|---|---|---|---|---|
| 6,666,580 | B2 * | 12/2003 | Bois | 383/61.2 |
| 6,863,645 | B2 * | 3/2005 | Crunkleton et al. | 493/212 |
| 2001/0053253 | A1 * | 12/2001 | Buchman et al. | 383/5 |
| 2002/0034339 | A1 | 3/2002 | Bois | |
| 2002/0094137 | A1 * | 7/2002 | Schneider et al. | 383/5 |
| 2004/0190798 | A1 * | 9/2004 | Ausnit | 383/64 |

FOREIGN PATENT DOCUMENTS

| | | | |
|---|---|---|---|
| EP | 1364883 | A2 | 11/2003 |
| EP | 1364883 | A3 | 11/2003 |
| EP | 1366999 | A1 | 12/2003 |
| EP | 1403191 | A1 | 3/2004 |
| EP | 1405798 | A2 | 4/2004 |
| EP | 1405798 | A3 | 4/2004 |

* cited by examiner

TAMPER-EVIDENT SLIDER-ACTUATED STRING-ZIPPERED BAG AND RELATED METHOD OF MANUFACTURE

RELATED PATENT APPLICATION

This application is a continuation-in-part of and claims priority from U.S. patent application Ser. No. 10/617,234 filed on Jul. 10, 2003 now U.S. Pat. No. 7,107,738 and entitled "Tamper-Evident Reclosable Bag Having Slider-Actuated String Zipper".

BACKGROUND OF THE INVENTION

This invention generally relates to reclosable bags having slider-actuated plastic zippers. In particular, the invention relates to reclosable bags having slider-actuated string zippers.

In the use of plastic bags, pouches and other packages, particularly for containing foodstuffs, it is important that the bag be hermetically sealed and tamper evident until the purchaser acquires the bag and its contents, takes them home, and opens the bag or package for the first time. It is then commercially attractive and useful for the consumer that the bag or package be reclosable so that its contents may be protected. Such bags provide the consumer with the ability to readily store, in a closed, if not sealed, package any unused portion of the packaged product even after the package is initially opened. Flexible plastic zippers have proven to be excellent for reclosable bags, because they may be manufactured with high-speed equipment and are reliable for repeated reuse.

Many reclosable bags comprise a receptacle having a mouth with a slider-actuated zipper installed therein for opening and closing the bag. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper strips can take on various configurations, e.g. interlocking rib and groove elements having so-called male and female profiles, interlocking alternating hook-shaped closure elements, interlocking ball-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper (with or without slider) inside an enclosed header cap or hood on the top of the bag. Another type of tamper-evident feature is the provision of a membrane on the product side of the zipper that partitions the interior volume in an airtight manner.

There is a continuing need for new designs for slider-actuated string-zippered bags with tamper-evident features that can be manufactured at low cost.

BRIEF DESCRIPTION OF THE INVENTION

The present invention is directed to reclosable bags that have a slider-actuated string zipper and tamper-evident features. The invention is further directed to methods of manufacturing such bags.

One aspect of the invention is a bag comprising: a receptacle having a mouth and an interior volume; a string zipper installed in the mouth; a slider mounted to the string zipper; a membrane depending within the interior volume to block access to a portion of the interior volume when the string zipper is open; and a hood joined to the receptacle and shrouding the mouth.

Another aspect of the invention is a bag comprising: (a) a string zipper comprising first and second flangeless zipper strips, the first flangeless zipper strip comprising a first base and a first closure profile projecting from the first base, and the second flangeless zipper strip comprising a second base and a second closure profile projecting from the second base and engaged with the first closure profile; (b) a film structure made of a film material, the film structure comprising: (i) a first bag wall comprising first and second sides; (ii) a second bag wall comprising first and second sides; and (iii) a folded panel having a first portion joined to the first base of the first flangeless zipper strip and to a first band-shaped portion of the first bag wall in a first zone of joinder, having a second portion joined to the second base of the second flangeless zipper strip and to a first band-shaped portion of the second bag wall in a second zone of joinder, having a third portion joined to a second band-shaped portion of the first bag wall in a third zone of joinder located at an elevation below the first zone of joinder, and having a fourth portion joined to a second band-shaped portion of the second bag wall in a fourth zone of joinder located at the same elevation as the third zone of joinder, the first and third zones of joinder extending from the first side of the first bag wall to the second side of the first bag wall, and the second and fourth zones of joinder extending from the first side of the second bag wall to the second side of the second bag wall; (c) a hood shrouding the string zipper and having a first portion joined to the first bag wall in the third zone of joinder and a second portion joined to the second bag wall in the fourth zone of joinder; and (d) a slider mounted on the string zipper and movable in opposite directions for opening and closing the string zipper, the slider comprising first and second sidewalls.

A further aspect of the invention is a bag comprising: a zipper comprising first and second flangeless zipper strips joined together at opposing ends of the zipper, the first zipper strip comprising a first base and a first closure profile projecting from the first base, and the second zipper strip comprising a second base and a second closure profile projecting from the second base and engaged with the first closure profile when the zipper is closed; a film structure made of film material and comprising a gusset and first and second bag walls joined to the gusset, the string zipper being disposed in the gusset, the gusset comprising first and second band-shaped portions respectively joined to the first and second flangeless zipper strips, the first bag wall comprising a first band-shaped portion joined to the first band-shaped portion of the gusset, and the second bag wall comprising a first band-shaped portion joined to the second band-shaped portion of the gusset; a slider mounted on the string zipper and movable in opposite directions for opening and closing the string zipper, the slider comprising first and second sidewalls, wherein the first band-shaped portion of the first bag wall is disposed between the first flangeless zipper strip and the first sidewall of the slider, and the first band-shaped portion of the second bag wall is disposed between the second flangeless zipper strip and the second sidewall of the slider; and a hood shrouding the string zipper and comprising a first band-shaped portion joined to a second band-shaped portion of the first bag wall, and further comprising a second band-shaped portion joined to a second band-shaped portion of the second bag wall, the second band-shaped portions of the first and second bag walls being generally aligned with each other.

Yet another aspect of the invention is a method of manufacture comprising the following steps: (a) applying non-sealable material on a film material in first and second band-shaped regions of the film material; (b) folding a portion of the film material to form a gusset comprising first and second gusset panels that are connected at a first fold, a first wall having a portion that confronts the first gusset panel and is connected to the first gusset panel at a second fold, and a second wall having a portion that confronts the second gusset panel and is connected to the second gusset panel at a third fold, the first through third folds being placed so that the first and second band-shaped regions of the film material form mutually confronting first portions of the first and second gusset panels respectively; (c) inserting a string zipper between mutually confronting second portions of the first and second gusset panels; (d) joining together the first portion of the first gusset panel, a first portion of the first wall and one side of the string zipper; (e) joining together the first portion of the second gusset panel, a first portion of the bag wall and another side of the string zipper; (f) inserting a slider on the string zipper after steps (d) and (e) have been performed; (g) placing a hood panel made of film material so that a first band-shaped region of the hood panel confronts a portion of the first wall that in turn confronts the first portion of the first gusset panel, and a second band-shaped region of the hood panel confronts a portion of the second wall that in turn confronts the second portion of the second gusset panel; (h) joining the first band-shaped region of the hood panel to the portion of the first wall that confronts the first portion of the first gusset panel; and (i) joining the second band-shaped region of the hood panel to the portion of the second wall that confronts the first portion of the second gusset panel.

A further aspect of the invention is a method of manufacturing a reclosable bag, comprising the following steps: (a) folding a first web of film material to form a portion having a generally M-shaped profile, the generally M-shaped portion comprising first and second gusset panels connected by a first fold, a first portion of a first wall connected to the first gusset panel by a second fold, and a first portion of a second wall connected to the second gusset panel by a third fold; (b) joining together the first gusset panel, the first portion of the first wall, and a back of a first flangeless zipper strip in a first zone of joinder; (c) joining together the second gusset panel, the first portion of the second wall, and a back of a second flangeless zipper strip in a second zone of joinder; (d) aligning the first and second flangeless zipper strips with each other; (e) mounting a slider onto the aligned first and second flangeless zipper strips; (f) placing a second web of film material so that a first band-shaped region of the second web confronts a second portion of the first wall, a second band-shaped region of the second web confronts a second portion of the second wall, and the second web shrouds the first and second flangeless zipper strips; and (g) joining the first band-shaped region of the second web to the second portion of the first wall in a third zone of joinder and joining the second band-shaped region of the second web to the second portion of the second wall in a fourth zone of joinder, without joining the first gusset panel to the second gusset panel in a space between the second portions of the first and second walls.

Another aspect of the invention is a method of manufacturing a reclosable bag, comprising the following steps: (a) folding a first web of film material to form first and second walls connected by a gusset, the gusset comprising mutually confronting first and second portions and mutually confronting third and fourth portions; (b) joining together the first portion of the gusset, a first portion of the first wall, and a first zipper strip; (c) joining together the second portion of the gusset, a first portion of the second wall, and a second zipper strip; (d) applying non-sealable material on a surface of the third portion of the gusset; (e) mounting a slider onto the first and second zipper strips; (f) placing a second web of film material so that a first portion of the second web confronts a second portion of the first wall, that in turn confronts the third region of the gusset; a second portion of the second web confronts a second portion of the second wall, that in turn confronts the fourth region of the gusset; and a third portion of the second web shrouds the first and second zipper strips; and (g) joining the first portion of the second web to the second portion of the first wall and joining the second portion of the second web to the second portion of the second wall, the non-sealable material preventing joinder of the third region of the gusset to the fourth region of the gusset.

Other aspects of the invention are disclosed and claimed below.

BRIEF DESCRIPTION OF THE DRAWINGS

FIG. 4 is a drawing showing a portion of a web of bag making film having two strips of non-sealable material applied thereon.

FIG. 5 is a drawing showing a fragmentary sectional view of a gusseted web with a string zipper inserted in the gusset, with trimming of excess web material indicated by respective dashed lines.

FIG. 6 is a drawing showing a fragmentary sectional view of a string zipper/web assembly with a slider inserted on the string zipper.

FIG. 7 is a drawing showing a fragmentary sectional view of a slider/string zipper/web assembly with a hood heat sealed to the outer walls.

FIG. 8 is a drawing showing a front view of a portion of a hood/slider/string zipper/web assembly to be sealed and severed (two cuts being indicated by respective dashed lines) to form a separate package or bag.

Reference will now be made to the drawings in which similar elements in different drawings bear the same reference numerals.

DETAILED DESCRIPTION OF THE INVENTION

Figure 1:
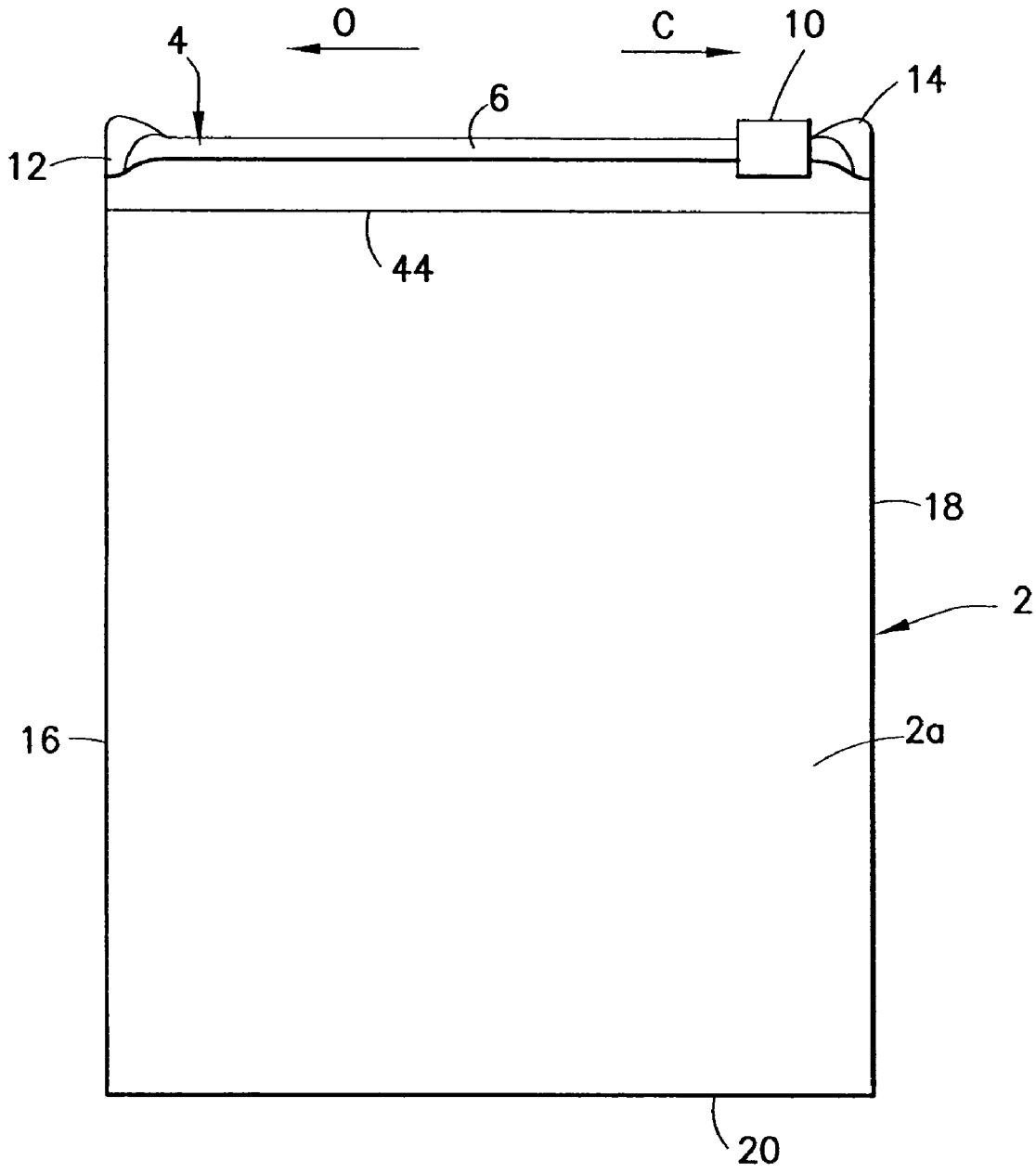
FIG. 1 PRIOR ART
FIG. 1 is a drawing showing a front view of a reclosable bag having a slider-actuated string zipper and an internal tamper-evident membrane, a bag of this type being disclosed in U.S. patent application Ser. No. 10/617,234. For the purpose of this illustration, it has been assumed that the bag film is optically transparent, so that the string zipper and the tamper-evident seal are visible behind a layer of film.

A reclosable package comprising a bag or receptacle 2 and a flexible plastic string zipper 4 operated by manipulation of a slider 10 is shown in FIG. 1. This package does not have a hood that shrouds the zippered mouth. It should be understood that the method disclosed herein can be used to add a hooded structure or shroud to a reclosable package of the type shown in FIG. 1 or other types of reclosable packages having different structures, but having in common a slider-actuated string zipper.

The bag 2 may be made from any suitable bag making film material, including a single layer of thermoplastic material or a laminate comprising two or more layers made of different materials, at least one of the layers being thermoplastic material. For example, the laminate could comprise two layers of different thermoplastic materials, a plastic-coated paper or a metallized thermoplastic film. Suitable thermoplastic materials include low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable thermoplastic materials is not exhaustive. The thickness of the bag making film is preferably 2 mils or less.

From a structural standpoint, the bag 2 comprises opposing walls (only the front panel 2*a* is visible in FIG. 1) that may be joined together at opposite side edges of the bag by means of respective heat seals 16 and 18, formed in conventional fashion, e.g., by cutting the walls with a hot knife that fuses one web to the other along the cut line. Alternatively, side seams could be made using sealing bars. The opposing marginal portions at the bottoms of the walls are also heat sealed together to form a bottom seam or cross seal 20. Alternatively, functionally equivalent means can be used. For example, the bottom seam could be made by applying ultrasonic wave energy instead of conductive heat or by inserting an adhesive bonding strip.

At its top end, the bag 2 has an openable mouth, on the inside of which is an extruded plastic string zipper 4. The string zipper 4 comprises a pair of interlockable zipper strips. One zipper strip 6 is visible in FIG. 1. The profiles of the zipper strips may take any form. For example, the zipper may comprise interlocking rib and groove elements, alternating hook-shaped closure elements, or interlocking ball-shaped closure elements. The preferred zipper material is polyethylene. Typically the upper margins of the front and rear bag walls are respectively sealed to the respective zipper strips by conduction heat sealing in band-shaped zones of joinder.

The zipper is operated by sliding the slider 10 along the zipper strips. As the slider moves across the zipper, the zipper is opened or closed. As shown in FIG. 1, the slider is slidable along the zipper in a closing direction "C", causing the zipper strips to become engaged, or in an opening direction "O", causing the zipper strips to become disengaged.

The bag shown in FIG. 1 further comprises end stops 12 and 14 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops typically comprise stomped areas on the zipper strips themselves. The stomped end stops comprise sections of the zipper strips that have been fused together and flattened at the ends of the zipper. This is typically accomplished by applying ultrasonic wave energy, but alternatively can be done by applying sufficient heat and pressure. Ultrasonic stomping can be carried out using ultrasonic welding equipment of the type disclosed in U.S. patent application Ser. No. 10/113,489, entitled "Method and Apparatus for Ultrasonically Stomping Slider End Stops on Zipper". Other methods for providing slider end stops can be used, e.g., attaching an inverted U-shaped clip at each end of the string zipper.

Figure 2:
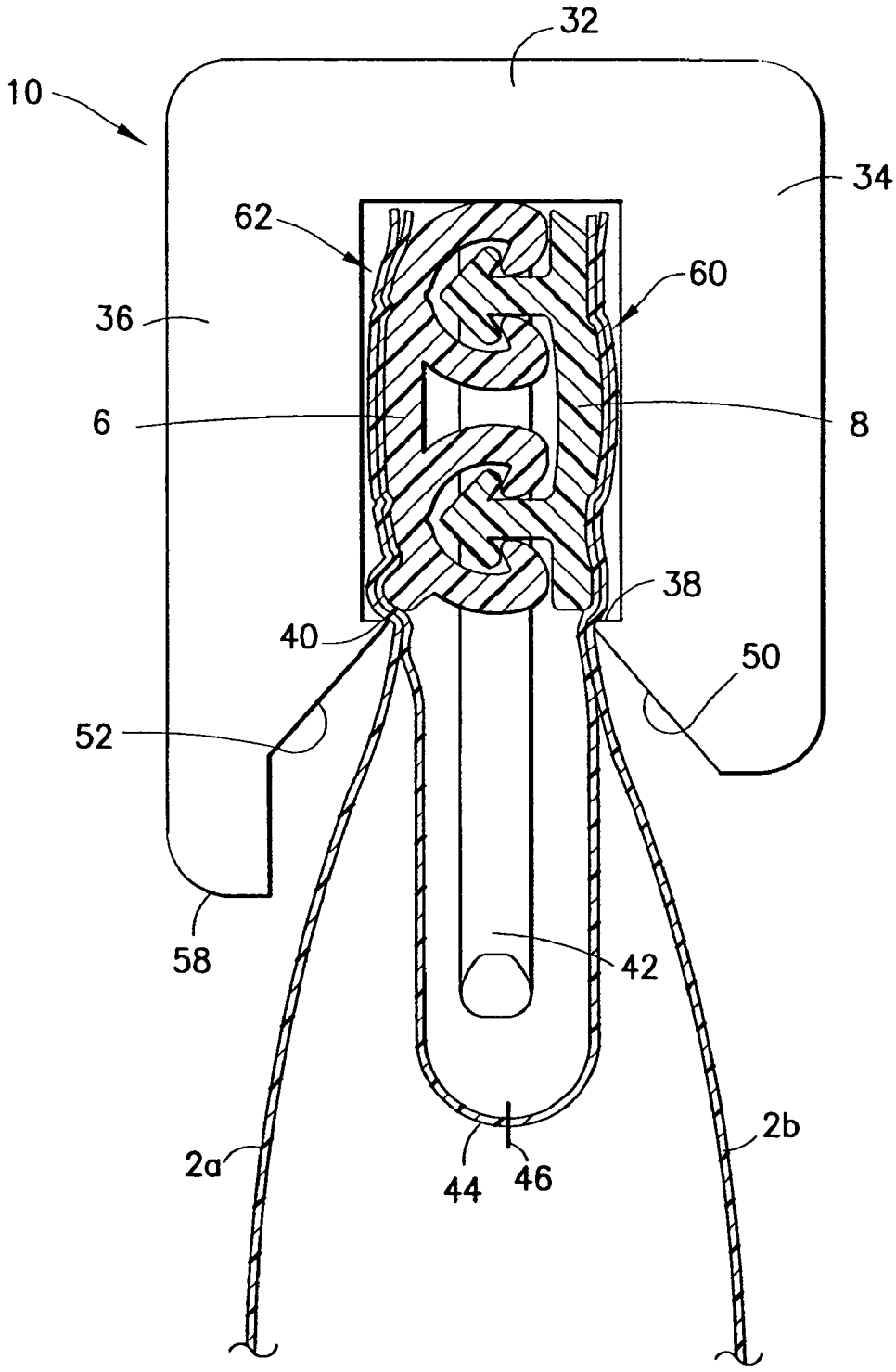
FIG.2 PRIOR ART
FIG. 2 is a drawing showing a fragmentary sectional view of a slider-string zipper assembly incorporated in the bag depicted in FIG. 1. The zipper and bag film are shown sectioned in a plane in front of the closing end of the slider. The portions of the zipper and receptacle disposed behind the section plane have not been shown to avoid cluttering the drawing.

A reclosable package or bag comprising a receptacle 2 and a flexible plastic string zipper 4, operated by manipulation of a slider 6, is partially shown in FIG. 2, adapted from U.S. patent application Ser. No. 10/617,234. The receptacle 2 comprises mutually opposing front and rear walls 2*a* and 2*b* that are joined together on three sides, as previously described with reference to FIG. 1. A tamper-evident membrane 44 is formed in the interior of the bag on the product side of the string zipper. The ends of the membrane 44 are sealed at the side seals 16 and 18. To gain access to the contents of the bag, the user must first open the zipper by moving the slider and then tear open or breach the membrane 44 disposed inside the bag. To facilitate breaching, the membrane may be provides with a line of weakened tear resistance (indicated by dashed line 46), which may, for example, comprise a line of spaced perforations or a scoreline running the length of the membrane. The perforations may be capped, as taught in U.S. Pat. No. 5,063,639.

Zipper strip 8 comprises a base and two generally arrow-shaped rib-like male closure elements or members projecting from the base. Zipper strip 6 comprises two pairs of hook-shaped gripper jaws connected by a sealing bridge. The pairs of gripper jaws form respective complementary female profiles for receiving the male profiles of zipper strip 8. Alternatively, one zipper strip could have one male profile and one female profile, while the other zipper strip has one female profile and one male profile, or the respective zipper strips could each have more than two male or female profiles. The sealing bridge of zipper strip 6 and the base of zipper strip 8 are resiliently flexible self-supporting structures having a thickness greater than the thickness of the bag film. The male closure elements are integrally formed with the base, while the female closure elements are integrally formed with the sealing bridge. Although FIG. 2 shows a rib and groove arrangement, the profiles of the zipper strips may take any form. For example, the string zipper may comprise interlocking rib and groove elements (as shown in FIG. 2), alternating hook-shaped closure elements or alternating ball-shaped closure elements. The preferred zipper material is polyethylene or polypropylene.

The merged marginal portions of the membrane 44 and the receptacle walls 2*a* and 2*b* may be respectively sealed to the backs of the zipper strips 6 and 8 by a conventional conduction heat sealing technique. The upper margins of the bag film may have short free ends, as seen in FIG. 2, provided that the free ends are not so long as to interfere with travel of the slider along the zipper or become entangled with the zipper profiles.

The slider 10 shown in FIG. 2 is fully disclosed in U.S. patent application Ser. No. 10/367,450 and comprises a top wall 32, a pair of side walls 34 and 36 connected to opposing sides of the top wall 32, the top wall 32 and side walls 34, 36 forming a tunnel for passage of the string zipper therethrough. The width of the tunnel is substantially constant along the section that is divided by a plow 42 and then narrows from a point proximal to the end of the plow to the closing window at one end face of the slider. The closing end of the slider is seen in FIG. 2. The plow 42 depends downward from a central portion of the top wall 32 to an elevation below the lowermost portions of each sidewall, and has rounded edges and flattened corners at the tip to facilitate insertion of the plow between the zipper profiles without snagging during automated slider insertion. As the slider is moved in the opening direction (i.e., with the closing end leading), the plow 42 pries the impinging sections of zipper strips 6 and 8 apart. The narrowing section of the slider tunnel is formed by a pair of substantially planar, inclined interior surfaces (not visible in FIG. 2), which converge toward the closing window of the slider. The inclined surfaces funnel or squeeze the zipper strips toward each other, causing the zipper profiles to interlock, as the slider is moved in the closing direction. The upper margins of the bag walls, joined to the backs of the zipper strips 6 and 8, are disposed between the respective zipper strips 6, 8 and the respective slider sidewalls 36, 34 of the slider. Also, the slider shown in FIG. 2 has one leg (i.e., side wall 36) longer than the other, to wit, an extension 58 of sidewall 36 projects to an elevation lower than the bottom edge of the opposing sidewall 34. This design facilitates proper orientation of the slider during automated feeding to a slider insertion device.

In the embodiment depicted in FIG. 2, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper, thereby increasing slider pull-off resistance. The ledges 38 and 40 further comprise respective inclined bottom surfaces 50 and 52 that extend downward and outward from the respective inner edges of the generally horizontal surfaces. The inclined surfaces 50 and 52 are each substantially planar and serve to guide the respective zipper strips 6 and 8 into the slider tunnel during automated insertion of the slider onto an open section of the zipper.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

It should be appreciated that the string zipper and slider depicted in FIG. 2 are purely exemplary and their structures have been disclosed in detail with no intent to limit the scope of the present invention to these specifically disclosed structures. For example, the reclosable bags with tamper-evident features and slider-actuated string zippers disclosed herein do not require that the slider have a separating finger. Sliders without separating fingers can also be employed, provided that the zipper strips are suitably designed to be actuated by such sliders.

Still referring to FIG. 2, the membrane 44 comprises a first layer of film material that has been folded to have a U- or V-shaped profile and that has respective marginal portions joined (e.g., by conduction heat sealing) to the backs of a pair of interlocked flangeless zipper strips 6 and 8. A second layer of the same film material, having a marginal portion merged with one marginal portion of the first layer, forms a front wall 2*a* of the receptacle 2, while a third layer of the same film material, having a marginal portion merged with the other marginal portion of the first layer, forms a rear wall 2*b* of the receptacle 2. [The merged portions of the first, second and third layers of film material are depicted as being distinct layers in FIGS. 2 and 3 for the purpose of illustration only. In reality, the interface between the melted layers of film would be less distinct, if not indistinguishable.] The front and rear walls 2*a* and 2*b* are typically sealed together along three sides (as illustrated in FIG. 1) to form the receptacle.

After the film material has been joined to the string zipper and any excess film beyond (i.e., above) the zipper has been trimmed, a slider is inserted on the string zipper. In the example depicted in FIG. 2, the slider has a separating finger or plow 42 that projects into an opening between opposing sections of the zipper strips. To open more zipper, the zipper strips 6 and 8 are pushed apart with sufficient force by the slider plow 42 to pry the heads of the male members out of the female profiles. When the shoulders of the male members clear the hooks of the outwardly flexed gripper jaws, the male and female members are no longer interlocked and the zipper is open.

Figure 3:
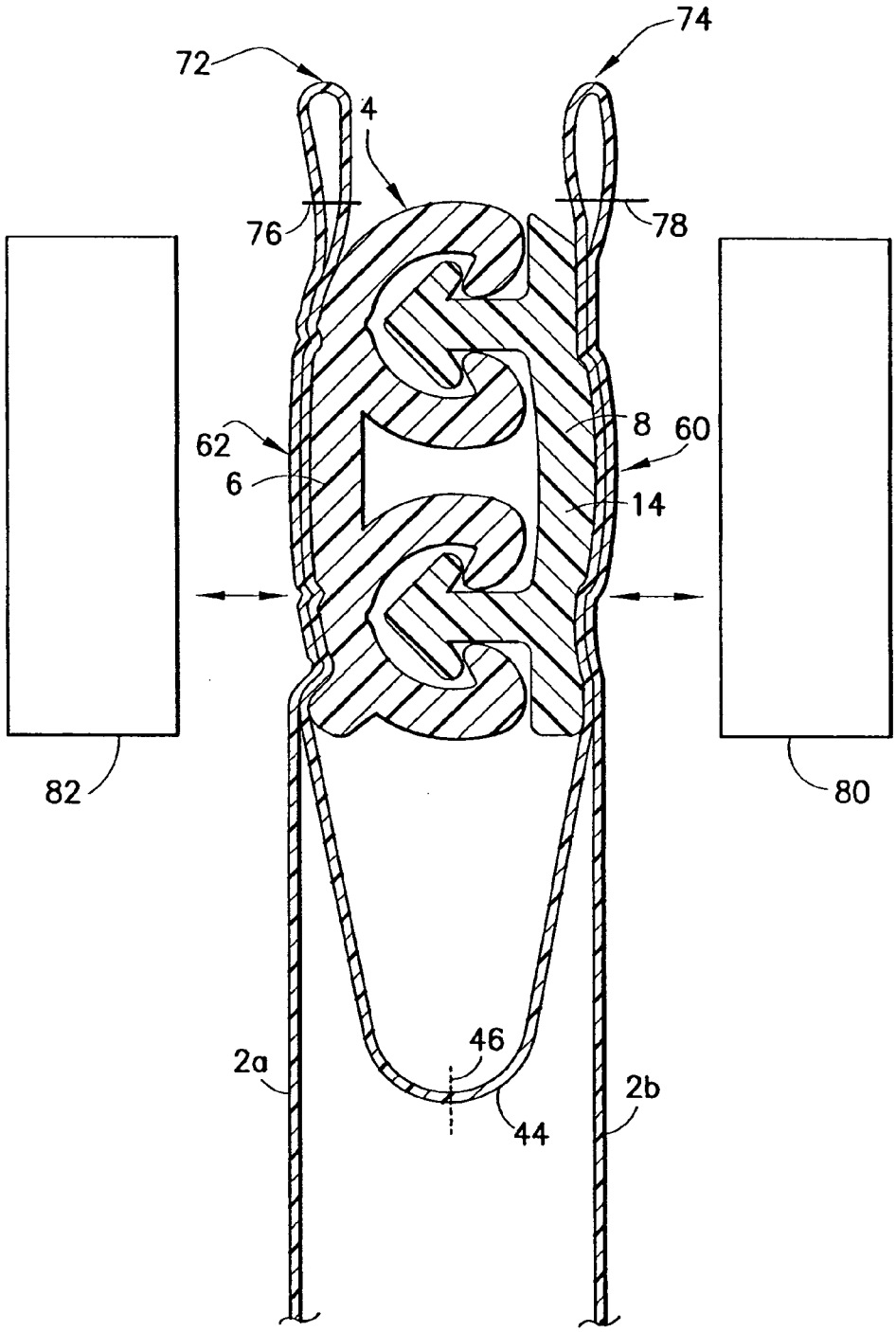
FIG.3 PRIOR ART
FIG. 3 is a drawing showing a fragmentary sectional view of a string zipper joined to a folded web at an intermediate stage in a manufacturing process disclosed in U.S. patent application Ser. No. 10/617,234.

FIG. 3 shows a stage in the manufacture of the bag partially depicted in FIG. 2. In accordance with this method of manufacture, one starts with a single web of film material that is folded three times to form an M-shaped gusseted end. The string zipper is inserted into the gusset (at a distance from the cusp of the gusset) and then the film is heat sealed to the string zipper on both sides to form merged double layers 60 and 62. A pair of heated sealing bars 80 and 82 are generally represented by rectangles spaced on opposing sides of the zipper. The sealing bars reciprocate between retracted positions (seen in FIG. 3) and extended positions (not shown). Heat sealing occurs when the extended sealing bars 80 and 82 press the double layers of film material against the respective backs of flangeless zipper strips 6 and 8. The sealing bars form band-shaped zones of joinder. After sealing of the double layers to the zipper, the loops 72 and 74 may extend above the zipper on respective sides thereof. These loops will later be trimmed by cutting along cut lines 76 and 78. After trimming of the loops 72 and 74, the upper margins of the double layers of bag film may have short free ends (below the cut lines 76 and 78 depicted in FIG. 3) that extend above the zones of joinder, provided that these free ends are not so long as to interfere with travel of the slider along the zipper or become entangled with the zipper profiles. Alternatively, the loops 72 and 74 may be sufficiently aligned with the zipper strips 6, 8 that no trimming is necessary.

While the provision of an internal membrane is effective in providing evidence of tampering to a consumer who, after purchasing a package and then opening the zipper to access the membrane, finds a broken membrane, such an internal membrane is ineffective in providing evidence of tampering before the consumer purchases the product. For example, someone could open the zipper of a package on a shelf in a store, tear open the internal membrane, tamper with the product inside the package, and then reclose the zipper, leaving no outward signs of tampering. Therefore, it is often desirable to provide a hood on the exterior that covers or shrouds the mouth of the bag, thereby blocking access to the zipper. If this hood is tom open, then evidence of tampering will be apparent to the consumer since the tear is outside, not inside the bag.

The embodiments disclosed herein improve upon the bag depicted in FIG. 2 by adding a hood (also known as a "shroud" or a "header cap") that is joined to the exterior of the bag walls and that passes over or shrouds the zippered mouth of the bag. A hood 88 in accordance with one embodiment of the invention is depicted in section in FIG. 7. A method of manufacturing such bags, in accordance with one embodiment of the invention, is depicted in FIGS. 4 through 8 and will now be described.

Figure 4:
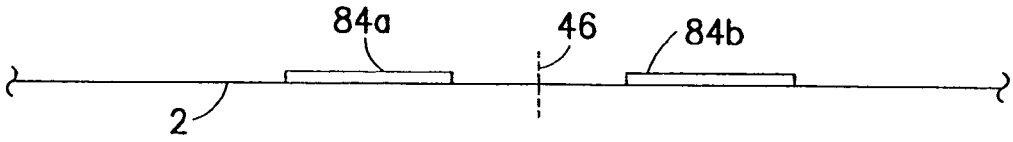
FIGS. 4-8 are drawings showing successive stages in the method of manufacture in accordance with one embodiment of the present invention.

First, as partially depicted in FIG. 4, a web 2 of bag making film (not yet folded) is paid out from a supply roll (not shown). Then two mutually parallel band-shaped areas on the web are coated with respective layers 84*a* and 84*b* of non-sealable material. [As used herein, the term "non-sealable material" means a material that is chosen for the purpose of being interposed between two layers of other material to prevent those layers from being sealed to each other. Certain printing inks will provide this feature or the extrusion of a high-density polyethylene layer on a base polyethylene layer, the former having a much higher melting point than the latter, can also be used.] In the example being discussed here, the non-sealable material has a melting temperature higher than the melting temperature of the film material. It is preferred that the non-sealable material be applied by extrusion on a continuously moving web of bag making film. In the example shown in FIG. 4, the mutually parallel band-shaped areas coated with non-sealable material are located on opposite sides of a centerline of the web that is parallel to the machine direction. The strips 84*a*, 84*b* of non-sealable material are equidistant from the centerline. In accordance with one method of manufacture, a line 46 of weakened tear resistance (e.g., a line of spaced perforations, a scoreline, etc.) is formed along the web centerline.

Figure 5:
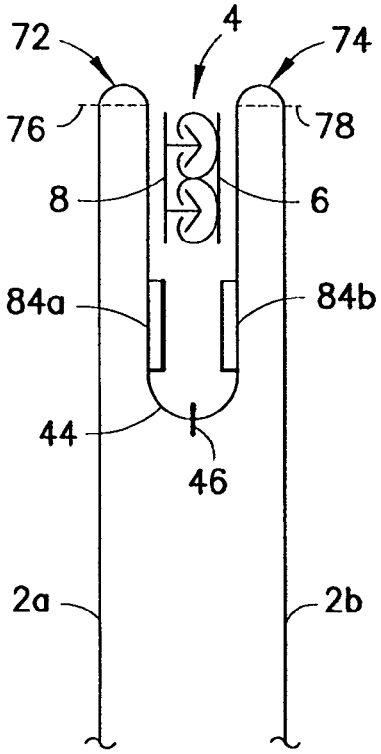
Figure 6:
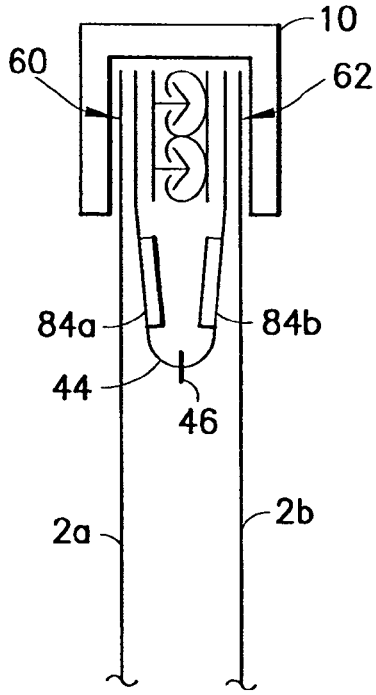

After the web has been coated in selected areas with non-sealable material, the film 2 is folded along three fold lines, as shown schematically in FIG. 5, to form a generally M-shaped gusseted portion comprising first through fourth layers of film material. The internal layers or panels form a generally U- or V-shaped membrane 44, while the outer layers form respective walls 2*a* and 2*b*. The height of the membrane 44 is less than the height of the walls 2*a*. 2*b*, the latter being only partially depicted in FIG. 5. The strips 84*a* and 84*b* of non-sealable material are disposed on the inside of the folded membrane 44 at the same elevation and directly confronting each other.

After the web of film 2 has been gusseted to form the membrane 44, a string zipper is inserted at an angle into the space between the two central (i.e., second and third) layers of the gusseted end. At a zipper sealing station, a section of zipper is sealed to both sides of the gusset or membrane 44, i.e., the first and second layers of the gusseted end are sealed to each other and to the back of one flangeless zipper strip 6; while the third and fourth layers of the gusseted end are sealed to each other and to the back of the other flangeless zipper strip 8. At the same time, opposing marginal portions at the lateral edges of the folded web of bag making film can be band-sealed together. This seal will become the bottom of the bag. After zipper sealing, the loops 72 and 74 above the zones of zipper/web joinder are trimmed, e.g., by stationary knives (not shown in FIG. 5), as the web with zipper is moving. The cut lines are indicated by dashed lines 76 and 78 respectively. This removes excess web material that might interfere with free travel of a slider along the length of the string zipper.

After trimming, a slider is inserted onto the string zipper by a slider insertion device and the zipper is ultrasonically stomped to form slider end stops. A suitable apparatus for inserting sliders onto string zipper material with attached bag making film is fully disclosed in U.S. patent application Ser. No. 10/436,433 entitled "Method and Apparatus for Inserting Sliders During Automated Manufacture of Reclosable Bags". The trimmed web with inserted slider 10 is partially depicted in FIG. 6. The zones of zipper-web joinder are generally indicated by arrows 60 and 62. At this juncture, the membrane 44 is not joined to the walls 2*a* and 2*b* at elevations below the string zipper, and the strips 84*a* and 84*b* of non-sealable material still confront each other.

Figure 7:
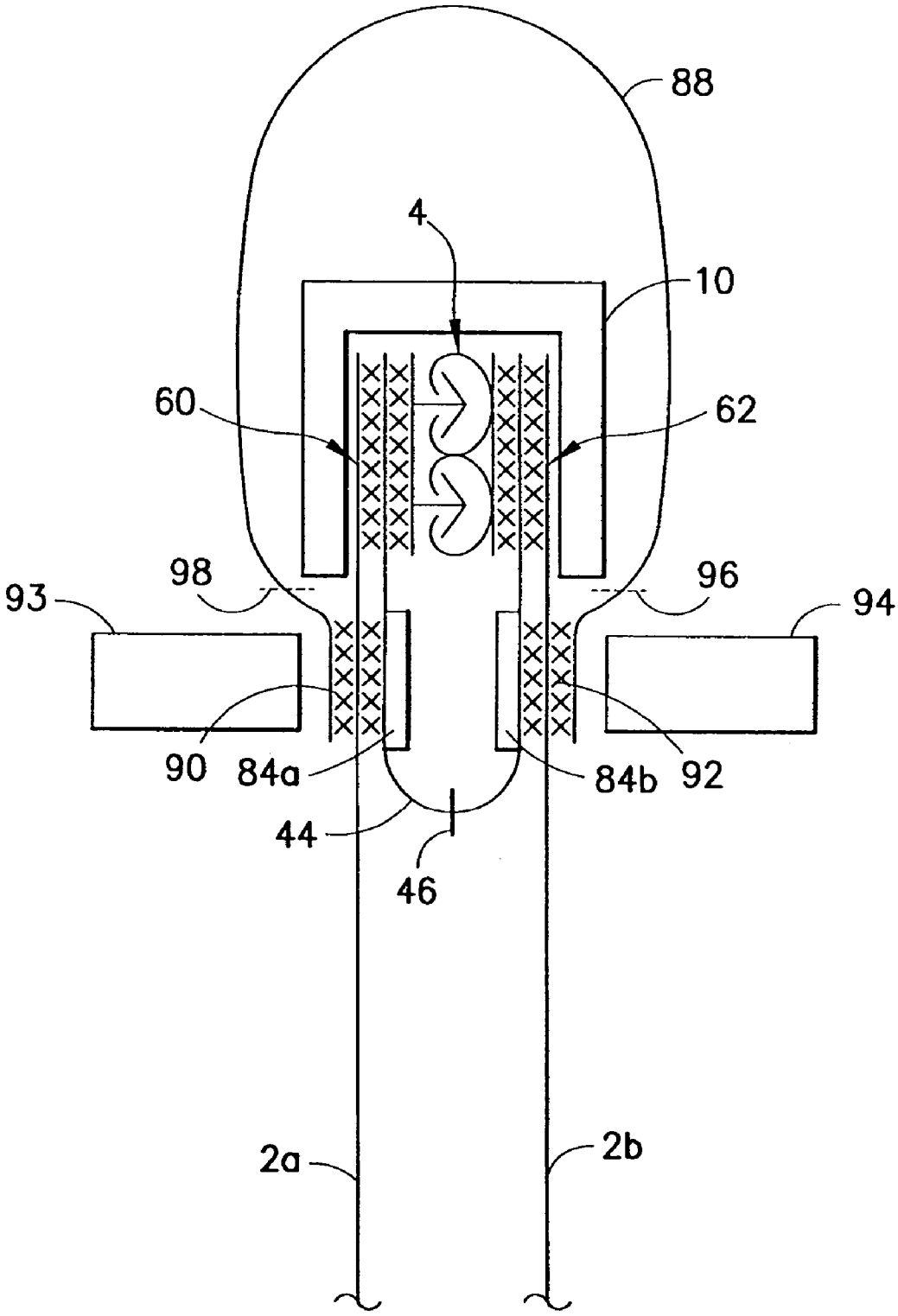
Figure 8:
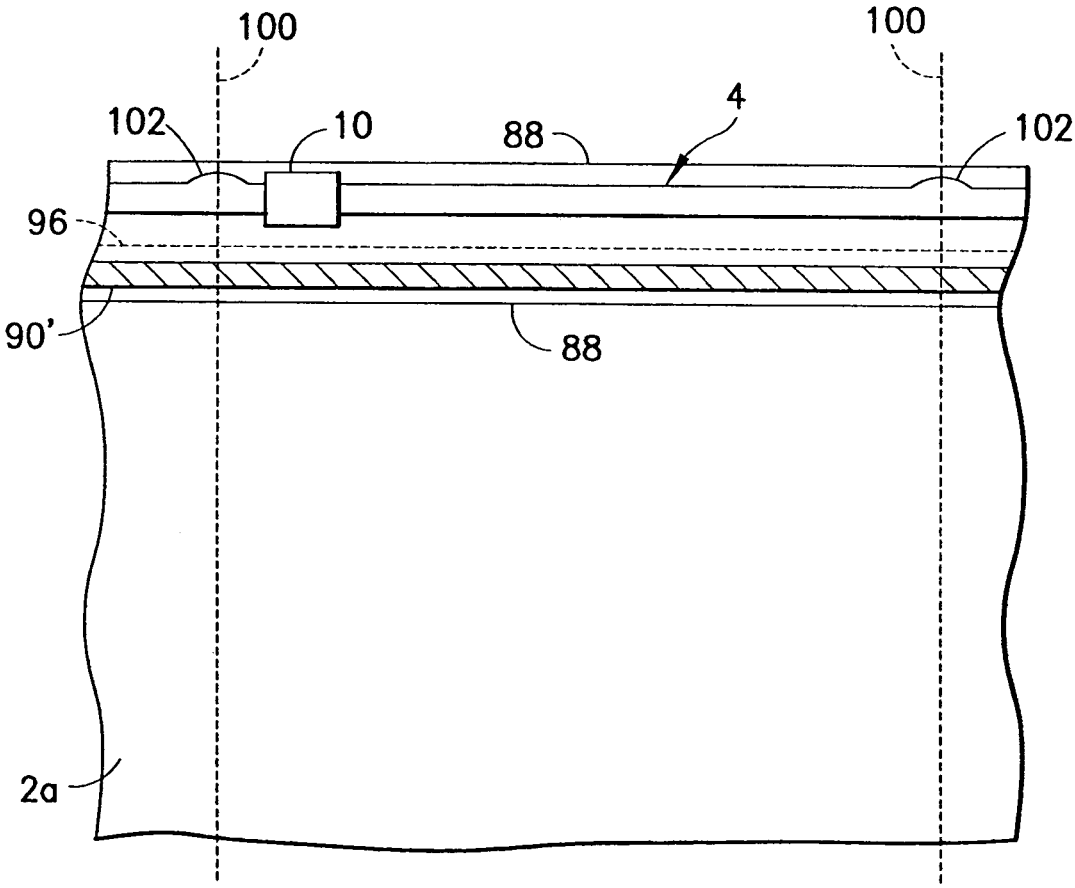

In the next stage of the manufacturing process, the hood 88 is attached to the bag walls 2*a* and 2*b*, as seen in FIG. 7. The hood comprises a strip of web material that is folded over the zippered mouth of the bag to form a shroud that blocks access to the slider 10 or the string zipper 4. The strip of web material has parallel lateral edges. Respective band-shaped portions of strip 88 that are disposed at or near the lateral edges are joined to the walls 2*a* and 2*b* respectively by conventional conduction heat sealing. This can be accomplished using a pair of reciprocating heated sealing bars 93 and 94. FIG. 7 shows these heated sealing bars in their respective retracted positions. In their extended positions, the heated sealing bars 93 and 94 press all of the intervening layers of material together (i.e., the marginal portions of hood 88, portions of walls 2*a*, 2*b*, portions on both sides of membrane 44, and strips 84*a* and 84*b* of non-sealable material) and apply sufficient heat to soften or melt material at the interfaces of the hood, bag walls and membrane, which softened or melted material fuses upon cooling to form respective band-shaped zones of joinder 90 and 92. In zone of joinder 90, one portion of the hood, one portion of wall 2*a* and one portion of membrane 44 are joined together, while in zone of joinder 90, another portion of the hood, one portion of wall 2*b* and another portion of membrane 44 are joined together. The non-sealable material is selected to have the property that, under the temperature and pressure conditions attending the heat sealing operation, the non-sealable material of strip 84*a*will not fuse or be joined to the non-sealable material of strip 84*b*, thereby preventing seal-through (i.e., joinder) of the opposing walls or panels of membrane 44. The heat seals are indicated by Xs in FIG. 7.

The walls 2*a*, 2*b*, membrane 44, hood 88 and string zipper 4 are then cut by a hot knife in a transverse direction at package-width intervals, each cutting line 100 (see FIG. 8) bisecting a respective ultrasonically stomped region 102 on the string zipper. The hot knife simultaneously severs the film and zipper and seals the film along the cut edges, thereby sealing the sides of the bag and the ends of the hood. Two successive transverse cuts sever one bag which may remain open at the bottom to allow subsequent filling. Alternatively, product can be placed between the two walls 2*a*, 2*b* and then the opposing marginal edges of the web are band-sealed together to form a bottom seal.

In accordance with a further aspect of the invention, the hood 88 may be provided with two lines of weakened tear resistance 96 and 98, as indicated by dashed lines in FIG. 7. These tear lines are preferably located at an elevation lower than the elevation of the slider and zipper, so that when a major portion of the hood 88 is removed by tearing along tear lines 96 and 98, the slider is fully exposed and accessible to the consumer. If the tear line 46 in membrane 44 is not hermetically sealed, then the tear lines 96 and 98 may be capped in accordance with the teaching of U.S. Pat. No. 5,063,639.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions. Further, in the absence of explicit language in any method claim setting forth the order in which certain steps should be performed, the method claims should not be construed to require that steps be performed in the order in which they are recited.

The invention claimed is:

1. A bag comprising: a receptacle having a mouth and an interior volume; a string zipper installed in said mouth and comprising first and second flangeless zipper strips; a slider mounted to said string zipper; a membrane depending within said interior volume to block access to a portion of said interior volume when said string zipper is open; and a hood joined to said receptacle and shrouding said mouth, wherein said receptacle comprises first and second outer walls and said hood comprises first and second portions that are respectively joined to respective first portions of said first and second outer walls in first and second zones of joinder respectively, said first and second zones of joinder being disposed at elevations lower than the elevation of a lowermost portion of said string zipper, and wherein said receptacle further comprises first and second inner walls integrally formed with and connected by said membrane, respective first portions of said first and second inner walls being respectively joined to said respective first portions of said first and second outer walls in said first and second zones of joinder respectively, wherein respective second portions of said first and second inner walls are respectively joined to respective second portions of said first and second outer walls of said receptacle and to respective backs of said first and second flangeless zipper strips respectively in third and fourth zones of joinder respectively.

2. The bag as recited in claim 1, further comprising nonsealable material that coats an area on a surface of said first inner wall, said area of nonsealable material being disposed between said first and second zones of joinder and being not joined to said second inner wall.

3. A bag comprising:

(a) a string zipper comprising first and second flangeless zipper strips, said first flangeless zipper strip comprising a first base and a first closure profile projecting from said first base, and said second flangeless zipper strip comprising a second base and a second closure profile projecting from said second base and engaged with said first closure profile;

(b) a film structure made of a film material, said film structure comprising:

(i) a first bag wall comprising first and second sides;

(ii) a second bag wall comprising first and second sides; and (iii) a folded panel having a first portion joined to said first base of said first flangeless zipper strip and to a first band-shaped portion of said first bag wall in a first zone of joinder, having a second portion joined to said second base of said second flangeless zipper strip and to a first band-shaped portion of said second bag wall in a second zone of joinder, having a third portion joined to a second band-shaped portion of said first bag wall in a third zone of joinder located at an elevation below said first zone of joinder, and having a fourth portion joined to a second band-shaped portion of said second bag wall in a fourth zone of joinder located at the same elevation as said third zone of joinder, said first and third zones of joinder extending from said first side of said first bag wall to said second side of said first bag wall, and said second and fourth zones of joinder extending from said first side of said second bag wall to said second side of said second bag wall;

(c) a hood shrouding said string zipper and having a first portion joined to said first bag wall in said third zone of joinder and a second portion joined to said second bag wall in said fourth zone of joinder; and (d) a slider mounted on said string zipper and movable in opposite directions for opening and closing said string zipper, said slider comprising first and second sidewalls.

4. The bag as recited in claim 3, further comprising nonsealable material that covers an area on a surface of said first portion of said folded panel, said area of non-sealable material being disposed between said third and fourth zones of joinder and being not joined to said second portion of said folded panel.

5. A bag comprising:

a zipper comprising first and second flangeless zipper strips joined together at opposing ends of said zipper, said first zipper strip comprising a first base and a first closure profile projecting from said first base, and said second zipper strip comprising a second base and a second closure profile projecting from said second base and engaged with said first closure profile when said zipper is closed;

a film structure made of film material and comprising a gusset and first and second bag walls joined to said gusset, said string zipper being disposed in said gusset, said gusset comprising first and second band-shaped portions respectively joined to said first and second flangeless zipper strips, said first bag wall comprising a first band-shaped portion joined to said first band-shaped portion of said gusset, and said second bag wall comprising a first band-shaped portion joined to said second band-shaped portion of said gusset;

a slider mounted on said string zipper and movable in opposite directions for opening and closing said string zipper, said slider comprising first and second sidewalls, wherein said first band-shaped portion of said first bag wall is disposed between said first flangeless zipper strip and said first sidewall of said slider, and said first band-shaped portion of said second bag wall is disposed between said second flangeless zipper strip and said second sidewall of said slider; and a hood shrouding said string zipper and comprising a first band-shaped portion joined to a second band-shaped portion of said first bag wall, and further comprising a second band-shaped portion joined to a second band-shaped portion of said second bag wall, said second band-shaped portions of said first and second bag walls being generally aligned with each other, wherein said second band-shaped portion of said first bag wall is joined to a third band-shaped portion of said gusset, and said second band-shaped portion of said second bag wall is joined to a fourth band-shaped portion of said gusset.

6. The bag as recited in claim 5, further comprising non-sealable material that coats a band-shaped area on said gusset that is disposed between said first and second band-shaped portions of said hood.

7. The bag as recited in claim 6, wherein said area of non-sealable material is disposed between said third and fourth band-shaped portions of said gusset.

8. The bag as recited in claim 5, wherein said film structure is generally rectangular in shape and comprises seals on three sides, said string zipper being installed on a fourth side of said film structure.

* * * * *